US007416614B2

(12) United States Patent
Tachisato

(10) Patent No.: US 7,416,614 B2
(45) Date of Patent: Aug. 26, 2008

(54) METHOD OF GAS CARBURIZING

(75) Inventor: Showa Tachisato, Yamatokoriyama (JP)

(73) Assignee: Koyo Thermo Systems Co., Ltd., Nara (JP)

( * ) Notice: Subject to any disclaimer, the term of this patent is extended or adjusted under 35 U.S.C. 154(b) by 0 days.

(21) Appl. No.: 10/487,398

(22) PCT Filed: Apr. 28, 2003

(86) PCT No.: PCT/JP03/05422

§ 371 (c)(1),
(2), (4) Date: Feb. 19, 2004

(87) PCT Pub. No.: WO03/104516

PCT Pub. Date: Dec. 18, 2003

(65) Prior Publication Data

US 2005/0205164 A1 Sep. 22, 2005

(30) Foreign Application Priority Data

Jun. 11, 2002 (WO) ..... PCT/JP02/05767
Nov. 26, 2002 (JP) ..... 2002-342505

(51) Int. Cl.
*C23C 8/22* (2006.01)

(52) U.S. Cl. ..... 148/225

(58) Field of Classification Search ..... 148/225
See application file for complete search history.

(56) References Cited

U.S. PATENT DOCUMENTS 2,012,165 A * 8/1935 Hansen et al. ..... 148/230
6,106,636 A * 8/2000 Naito et al. ..... 148/215

FOREIGN PATENT DOCUMENTS

GB 2 284 616 6/1995

(Continued)

OTHER PUBLICATIONS

S. F. Yur'ev and S. K. Ginzburg, Investigation of High-Temperature Carburizing of Steel in Soid Carburizer With High-Frequency Heating, Aug. 1959, Metallovedeniei Term. Obrabotka, pp. 32-38.*

(Continued)

*Primary Examiner*—John P. Sheehan
*Assistant Examiner*—Jessee Roe
(74) *Attorney, Agent, or Firm*—Jordan and Hamburg LLP

(57) ABSTRACT

A method of gas carburizing is carried out at a carburizing temperature which is not higher than a peritectic point temperature at which δ iron and liquid phase are transformed into γ iron and not less than a eutectic point temperature at which liquid phase is transformed into γ iron and cementite. The method comprises the step of predetermining the limiting carburizing conditions at which the surface layer of a sample of a steel treatment object present in a carburizing atmosphere is austenitized without melting and the step of gas carburizing the treatment object under carburizing conditions which are set so as not to contradict the limiting carburizing conditions, at a carburizing temperature which is not higher than the peritectic point temperature and not less than the eutectic point temperature. The limiting carburizing conditions comprise an upper limit value of a partial pressure of carburizing gas at which the surface layer of the sample is austenitized without melting.

10 Claims, 14 Drawing Sheets

FOREIGN PATENT DOCUMENTS

| | | | |
|---|---|---|---|
| JP | 1994-45868 | | 6/1994 |
| JP | 6-192815 | | 7/1994 |
| JP | 9-59756 | | 3/1997 |
| JP | 09-059756 | * | 3/1997 |
| JP | 10-121128 | | 5/1998 |
| JP | 11-200009 | * | 7/1999 |
| JP | 2000-129418 | | 5/2000 |
| JP | 2001-81543 | | 3/2001 |
| JP | 2001-214255 | | 8/2001 |

OTHER PUBLICATIONS

The ASM Handbook (Davis et al.), Gas Carburizing, Aug. 1991, vol. 4, pp. 315-317.*

* cited by examiner

100μm

100μm

METHOD OF GAS CARBURIZING

TECHNICAL FIELD

The present invention relates to a method for gas carburizing steel parts used, for example, in the automobile industry or machine industry.

BACKGROUND ART

When gas carburizing of steel treatment objects is carried out, the carburizing treatment time can be shortened by raising the carburizing temperature. However, if the carburizing temperature becomes too high, the treatment object melts down. For this reason, the carburizing temperature that has been conventionally used in practice was less than the eutectic point temperature (in the case of an iron-carbon equilibrium diagram shown in FIG. 1, it is the C point temperature which is 1147° C.) at which the liquid phase is transformed into γ iron and cementite, and usually was not higher than 1050° C.

In order to shorten the carburizing treatment time at the conventional carburizing temperature, the carburizing treatment was carried out till the concentration of carbon in the surface layer of the treatment object became higher than the final target value, and then diffusion treatment which caused the carbon in the surface layer of the treatment object to diffuse was carried out in a high-temperature atmosphere with a carbon concentration less than that of the carburizing atmosphere, thereby decreasing the carbon concentration in the surface layer to the final target value (Japanese Examined Patent Publication No. 1994-45868).

However, when the carburizing temperature is limited to a temperature less than the eutectic point temperature, the diffusion rate of carbon atoms in the treatment object is restricted. Therefore, the carburizing time cannot be shortened significantly. Thus, the problem is that the diffusion treatment requires a long time, thereby reducing productivity.

It is an object of the present invention to provide a method of gas carburizing capable of resolving the aforesaid conventional problems.

DISCLOSURE OF INVENTION

A method of gas carburizing according to an aspect of the present invention comprises the steps of predetermining limiting carburizing conditions at which the surface layer of a sample of a steel treatment object present in a carburizing atmosphere is austenitized without melting at a carburizing temperature which is not higher than a peritectic point temperature at which δ iron and liquid phase are transformed into γ iron and not less than a eutectic point temperature at which liquid phase is transformed into γ iron and cementite; and gas carburizing the treatment object under carburizing conditions which are set so as not to contradict the limiting carburizing conditions, at a carburizing temperature which is not higher than the peritectic point temperature and not less than the eutectic point temperature, wherein the limiting carburizing conditions comprise an upper limit value of a partial pressure of carburizing gas in the carburizing atmosphere at which the surface layer of the sample is austenitized without melting. Thus, the carburizing time is shortened by gas carburizing the treatment object which is austenitized by being heated to a highest possible temperature. By increasing the carburizing gas concentration in the carburizing atmosphere, the hardened layer of the treatment object can be prevented from becoming shallow and have sufficient thickness within a short time.

The treatment object is austenitized when heated to a temperature above the GS line or ES line in the iron-carbon equilibrium diagram shown in FIG. 1. If the concentration of carbon in the surface layer of the treatment object exceeds the JE line, melting is started in the surface layer. The present inventor has found out that an upper limit value of a partial pressure of carburizing gas at which the surface layer of the treatment object is not melted exists under given carburizing conditions such as carburizing temperature and carburizing time, and that this upper limit value decreases with the increase in carburizing temperature and increases with the decrease in carburizing time. Because the carburizing temperature range in the method of gas carburizing in accordance with the present invention is from not higher than the peritectic point temperature (1494° C.) to not less than the eutectic point temperature (1147° C.), the carburizing time can be greatly reduced. Moreover, setting the partial pressure of carburizing gas to not higher than the predetermined upper limit value makes it possible to carry out carburizing at a high temperature without causing melting in the surface layer of the treatment object. As a result, the amount of consumed energy can be greatly reduced and energy can be saved. Furthermore, the gas carburizing process can be carried out in series with other processes, for example, machining processes or different heat treatment processes.

It is preferred that the limiting carburizing conditions comprise an upper limit value of carburizing temperature and an upper limit value of carburizing time at which the surface layer of the sample is austenitized without melting, the relationship between the upper limit value of the partial pressure of carburizing gas, the upper limit value of carburizing temperature, and the upper limit value of carburizing time is predetermined, and the partial pressure of carburizing gas, carburizing temperature, and carburizing time are set such that the carburizing conditions of the treatment object do not contradict the limiting carburizing conditions which satisfy the predetermined relationship. The upper limit value of the partial pressure of carburizing gas, the upper limit value of carburizing temperature, and the upper limit value of carburizing time serving as the limiting carburizing conditions are interrelated and one of the upper limit values can be found by fixing the other two conditions among the partial pressure of carburizing gas, carburizing temperature, and carburizing time. As a result, the conditions providing for the fastest possible carburization can be easily set within a range in which the surface layer of the treatment object is not melted.

A method of gas carburizing according to another aspect of the present invention is characterized in that when gas carburization of a steel treatment object is carried out, a carburizing temperature is set at a temperature which is not higher than a peritectic point temperature (it is the J point temperature which is 1494° C. in the case shown in FIG. 1) at which δ iron and liquid phase are transformed into γ iron and not less than a eutectic point temperature (it is the C point temperature which is 1147° C. in the case shown in FIG. 1) at which liquid phase is transformed into γ iron and cementite, a target value of carbon concentration in the surface of the treatment object is set at a value which is not higher than a value at which the surface of the treatment object is not melted at the set carburizing temperature, and a partial pressure of carburizing gas in the carburizing atmosphere is set at a value at which the carbon concentration in the surface of the treatment object can reach the set target value as a result of gas carburization carried out during a preset time. The present invention is based on the discovery that when the carburizing temperature is set at a temperature which is not higher than the peritectic point temperature and is not less than the eutectic point temperature and the target value of carbon concentration in the surface of the steel treatment object is set at a value which is not higher than the value at which the surface of the treatment object is not melted at the set carburizing temperature, if the partial pressure of carburizing gas in the carburizing atmosphere is set at an appropriate value, then the carbon concentration in the surface of the treatment object can reach the set target value as a result of gas carburization and a sufficient carburizing depth can be obtained. Because carburization at a high temperature increases the movement rate of carbon atoms in the course of carburization over that attained by the conventional technology, the hardened layer depth that required several hours to be attained by the conventional technology can be attained within a short time. Moreover an excess increase in the concentration of carbon in the surface is prevented.

As a result, the carburizing time can be shortened significantly by raising the carburizing temperature. Moreover, because the concentration of carbon in the surface layer of the treatment object does not exceed the set target value, the carbon diffusion treatment process is unnecessary. As a result, productivity can be increased. Furthermore, the gas carburizing treatment process can be carried out in series with other heat treatment processes. Therefore, it is preferred that the treatment object is cooled without carrying out a diffusion treatment after the gas carburization has been carried out. It is also preferred that the treatment object is reheated after the cooling. The reheating is carried out, for example, by induction heating. It is also preferred that quenching treatment of the reheated treatment object is carried out. Cooling for the quenching treatment is carried out, for example, by oil cooling or gas cooling. In terms of shortening the carburizing time, it is preferred that the carburizing temperature is set at 1200° C. or higher. In this case, prior to implementing the method of gas carburizing, it is preferred that limiting carburizing conditions are predetermined, those conditions are set such that the surface layer of a sample of a steel treatment object present in a carburizing atmosphere is austenitized without melting at a carburizing temperature which is not higher than the peritectic point temperature at which δ iron and liquid phase are transformed into γ iron and is not less than the eutectic point temperature at which liquid phase is transformed into γ iron and cementite. The limiting carburizing conditions comprise the upper limit value of the partial pressure of carburizing gas in the carburizing atmosphere at which the surface layer of the sample is austenitized without melting. The treatment object is austenitized when heated to a temperature above the GS line or ES line in the iron-carbon equilibrium diagram shown in FIG. 1. If the concentration of carbon in the surface layer of the treatment object exceeds the JE line, melting is started in the surface layer. An upper limit value of the partial pressure of carburizing gas at which the surface layer of the treatment object is not melted exists under given carburizing conditions such as carburizing temperature and carburizing time. Predetermining the limiting carburizing conditions comprising the upper limit value of the partial pressure of carburizing gas facilitates setting the partial pressure of carburizing gas and carburizing time.

In the present invention, the total pressure of carburizing atmosphere can be a normal pressure, or can be decreased or increased with respect to the normal pressure. The entire carburizing atmosphere can be a carburizing gas, or a gas mixture of a carburizing gas and a dilute gas can be used as the carburizing atmosphere. When a dilute gas is used, dilution is preferably carried out with an inert gas such as nitrogen gas or argon gas. No specific limitation is placed on the type of steel of the treatment object which is subjected to gas carburizing by the method according to the present invention, and the method of the present invention is applicable to any steel provided that it can be austenitized at a temperature which is not higher than the peritectic point temperature and not less than the eutectic point temperature. This steel can be not only a carbon steel but also an alloy steel.

In the present invention, it is preferred that heating of the treatment object and a sample thereof is carried out with means capable of high-speed heating of the surface layer thereof. The heating is preferably carried out, for example, by induction heating or laser heating. As a result, heating efficiency of the carburization object can be increased. Furthermore, because the carburizing treatment is simplified, quality control is facilitated. Thus, because the number of factors affecting the quality is small, even if quality problems such as spots, strains, or cracks in the treatment object are encountered, the causes thereof can be easily clarified. Furthermore, a wall covering the carburizing treatment space can be a cold wall and a waste gas combustion apparatus is unnecessary; therefore, degradation of working conditions is prevented and initial investment is reduced, moreover the method is applicable to single-item and small-scale production and can be easily incorporated into a production line, for example, in-line treatment of the individual production can be carried out. Because the conventional carburizing treatment furnace equipped with thermally insulating walls is not required, furnace heating or seasoning become unnecessary and running cost can be reduced.

In the present invention, the gas carburizing is preferably carried out, while causing a carburizing atmosphere comprising the carburizing gas at a constant partial pressure to flow. As a result, a constant partial pressure of carburizing gas can be maintained and treated products of uniform quality can be obtained.

The method of gas carburizing according to the present invention can greatly improve productivity.

BEST MODE FOR CARRYING OUT THE INVENTION

Figure 2:
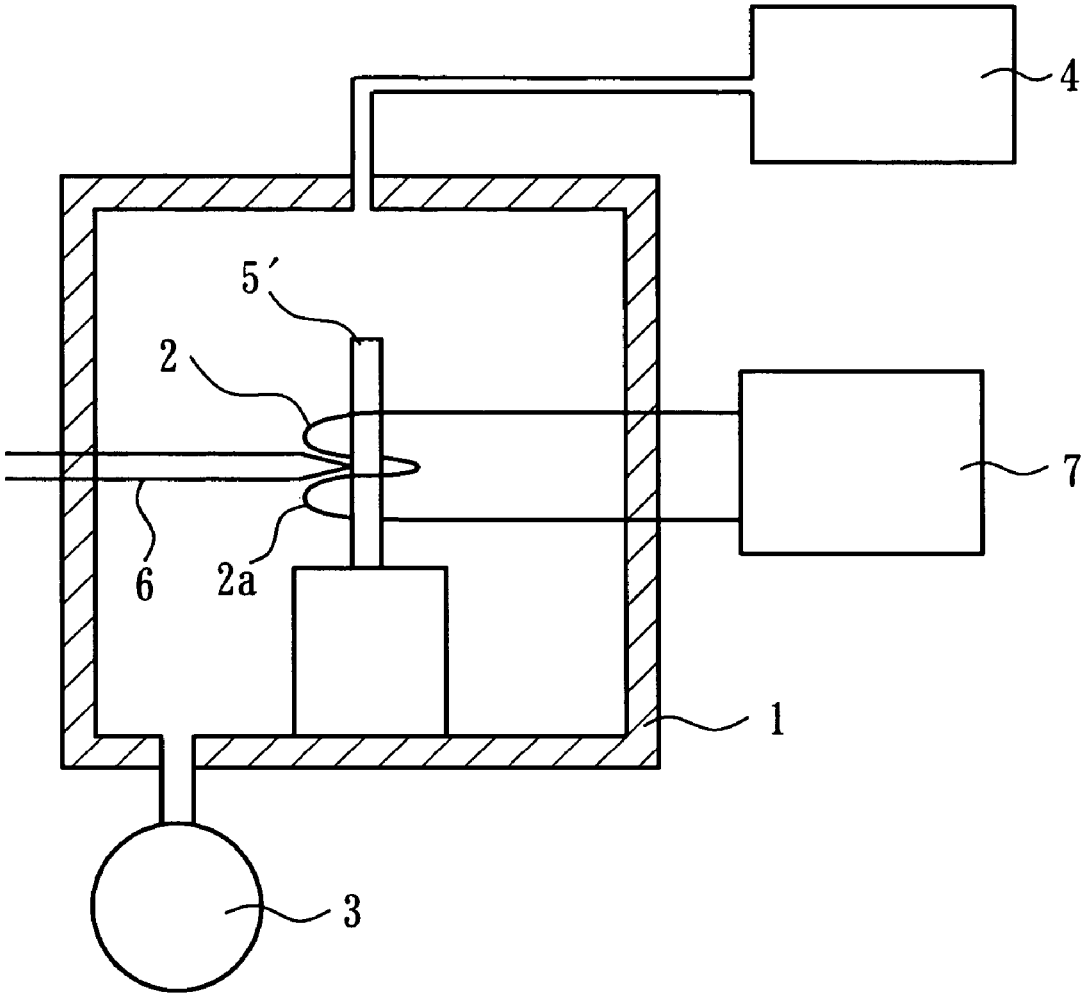
FIG. 2 illustrates the state of heating a sample of the treatment object by the gas carburizing apparatus in an embodiment of the present invention.

The gas carburizing apparatus which is an embodiment of the present invention shown in FIG. 2 comprises a vacuum container 1, a heating device 2, a vacuum pump 3 for reducing the pressure inside the vacuum container 1, and a gas source 4 for supplying gas for carburizing atmosphere into the vacuum container 1. In the present embodiment, the heating device 2 carries out induction heating inside the vacuum container 1 with a coil 2*a* connected to a power source 7. The output of the power source 7 to the coil 2*a* is variable.

First, in order to carry out gas carburization of a sample 5' of a steel treatment object, a thermocouple 6 is welded as a sensor for temperature detection to the surface layer of the sample 5' set in the heating device 2. Then, the pressure inside the vacuum container 1 is reduced by evacuating the vacuum container 1 with the vacuum pump 3. At this time, the pressure inside the vacuum container 1 is preferably about 27 Pa or less. Means for detecting the temperature is not limited to a thermocouple.

After such pressure reduction, a gas for carburizing atmosphere is introduced from the gas source 4 into the vacuum container 1. As a result, the vacuum container 1 is filled with the carburizing atmosphere and the total pressure of the carburizing atmosphere is raised. For example, the pressure of the carburizing atmosphere inside the vacuum container 1 is raised to about 80 kPa. The carburizing atmosphere is composed of a carburizing gas and a dilute gas. No specific limitation is placed on the type of the carburizing gas or dilute gas. The carburizing gas of the present embodiment is methane gas and the dilute gas is nitrogen gas. Using a hydrocarbon gas as the carburizing gas makes it possible to realize a non-oxidizing carburization. The carburizing gas is not limited to hydrocarbon gases. The carburizing atmosphere may also be composed only of a carburizing gas.

In order to maintain a constant total pressure of carburizing atmosphere inside the vacuum container 1, the gas for carburizing atmosphere is supplied from the gas source 4 into the vacuum container 1 at a constant flow rate, and the gas for carburizing atmosphere is released by the vacuum pump 3 at a constant flow rate. As a result, the gas for carburizing atmosphere flows inside the vacuum container 1 at a constant flow rate of, for example, 0.5 L/min, and the total pressure of the carburizing atmosphere is maintained at, for example, about 80 kPa. Thus, the carburizing atmosphere containing a carburizing gas at a constant partial pressure flows inside the vacuum container 1. The partial pressure of carburizing gas is a value obtained by multiplying the total pressure of carburizing atmosphere inside the vacuum container 1 by a molar fraction or volume percent of the carburizing gas. Therefore, the set value of the partial pressure of carburizing gas can be adjusted by changing the total pressure of carburizing atmosphere inside the vacuum container 1 or by changing the flow rate ratio of the carburizing gas and dilute gas.

Then, the sample 5' is heated with the heating device 2 to a set carburizing temperature. The carburizing temperature is not higher than the peritectic point temperature at which δ iron and liquid phase are transformed into γ iron and not less than the eutectic point temperature at which liquid phase is transformed into γ iron and cementite. The set value of the carburizing temperature can be adjusted by changing the output of the heating device 2 to the coil 2*a*.

When the sample 5' is gas carburized by holding for the set carburizing time under the set partial pressure of carburizing gas and the set carburizing temperature, it is checked to see whether the surface layer of the sample 5' is melted or not.

If the surface layer of the sample 5' has not melted during the carburization, another carburization of another sample 5' is carried out by increasing the set value of the partial pressure of carburizing gas. If the surface layer of the sample 5' has melted, another carburization of another sample 5' is carried out by decreasing the set value of the partial pressure of carburizing gas. By repeating this process, the upper limit value of the partial pressure of carburizing gas is predetermined as a limit carburizing condition at which austenitization is conducted without melting the surface layer of the sample 5'.

A method for predetermining the upper limit value of the partial pressure of carburizing gas by fixing the carburizing temperature and carburizing time was described hereinabove, but this method can be appropriately modified without departing from the essence of the present invention. Thus, the upper limit value of carburizing time can be found by fixing the partial pressure of carburizing gas and carburizing temperature, or the upper limit value of carburizing temperature can be found by fixing the partial pressure of carburizing gas and carburizing time.

Figure 3:
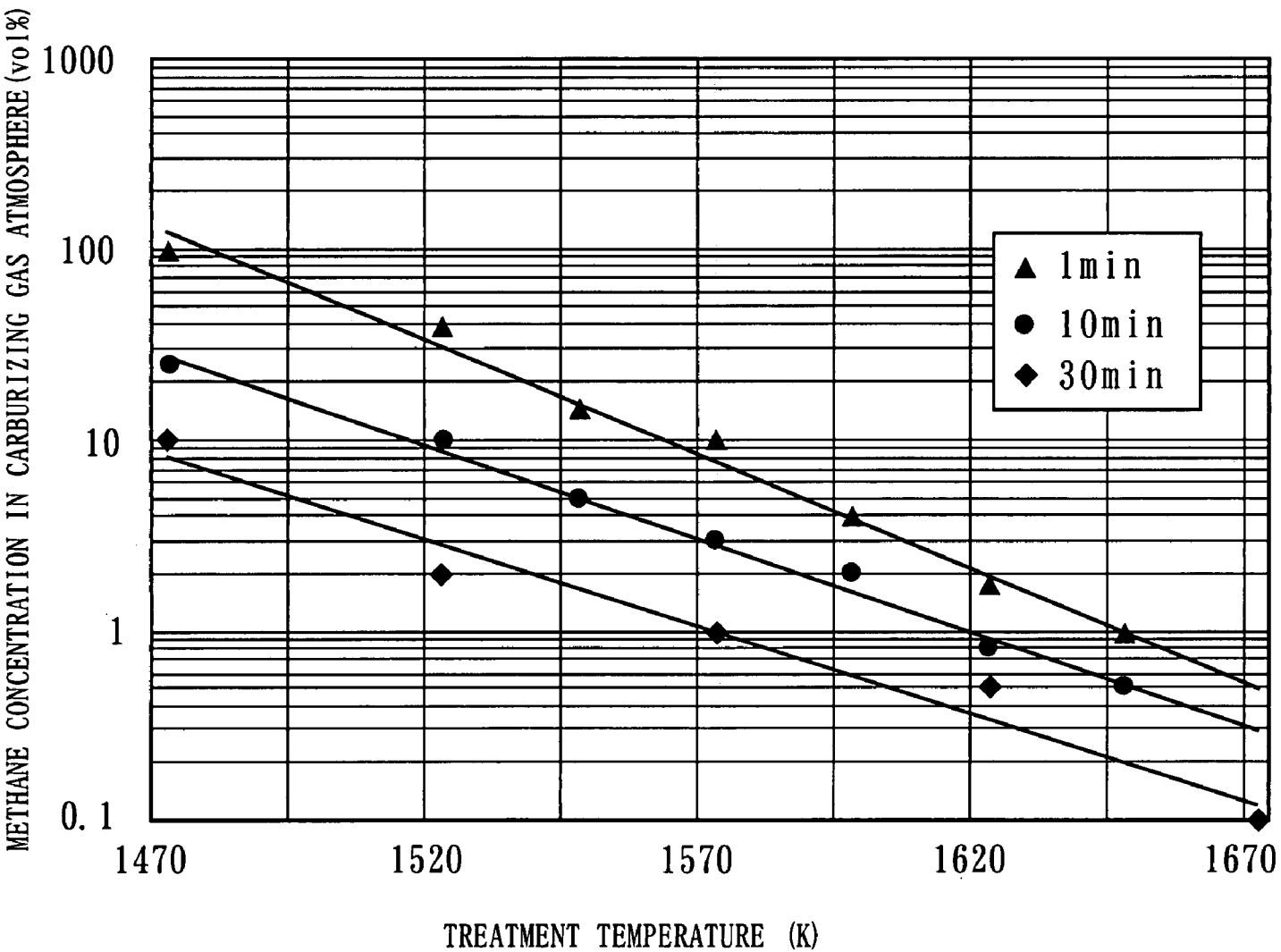
FIG. 3 illustrates an example of relationship between the upper limit value of partial pressure of carburizing gas, different carburizing temperatures and carburizing times.

FIG. 3 shows an example of the relationship between the upper limit value of the partial pressure of carburizing gas, the upper limit value of carburizing temperature, and the upper limit value of carburizing time predetermined in the above-described manner. In the present embodiment, the concentration of methane (vol %) in carburizing atmosphere corresponding to the partial pressure of carburizing gas is plotted on the ordinate in FIG. 3, but the partial pressure of carburizing gas may also be represented by another. For example, when no dilute gas is used, the partial pressure of carburizing gas is equal to the total pressure of carburizing atmosphere, and therefore the methane flow rate can be used to represent the partial pressure of carburizing gas. By using a similar method it is possible to find not only the lines for 1 min, 3 min, and 30 min shown in FIG. 3, but also any line or curve located therebetween. As shown in FIG. 3, the upper limit value of the partial pressure of carburizing gas in the carburizing atmosphere decreases with the increase in carburizing temperature and increases with the decrease in carburizing time. Further, the relationship shown in FIG. 3 is merely an example, and this relationship differs depending on the arrangement of structural components of heating device 2, material and arrangement of sample 5' to the heating device 2, type of heating device 2, type and flow rate of carburizing gas, and the like.

Gas carburization of a steel treatment object 5 is thereafter carried out by using the above-described apparatus for gas carburization under the carburizing conditions which are set so as not to contradict the limiting carburizing conditions satisfying the predetermined relationship. Carburization of the steel treatment object 5 can be carried out in the same manner as carburization of the sample 5'.

Figure 4:
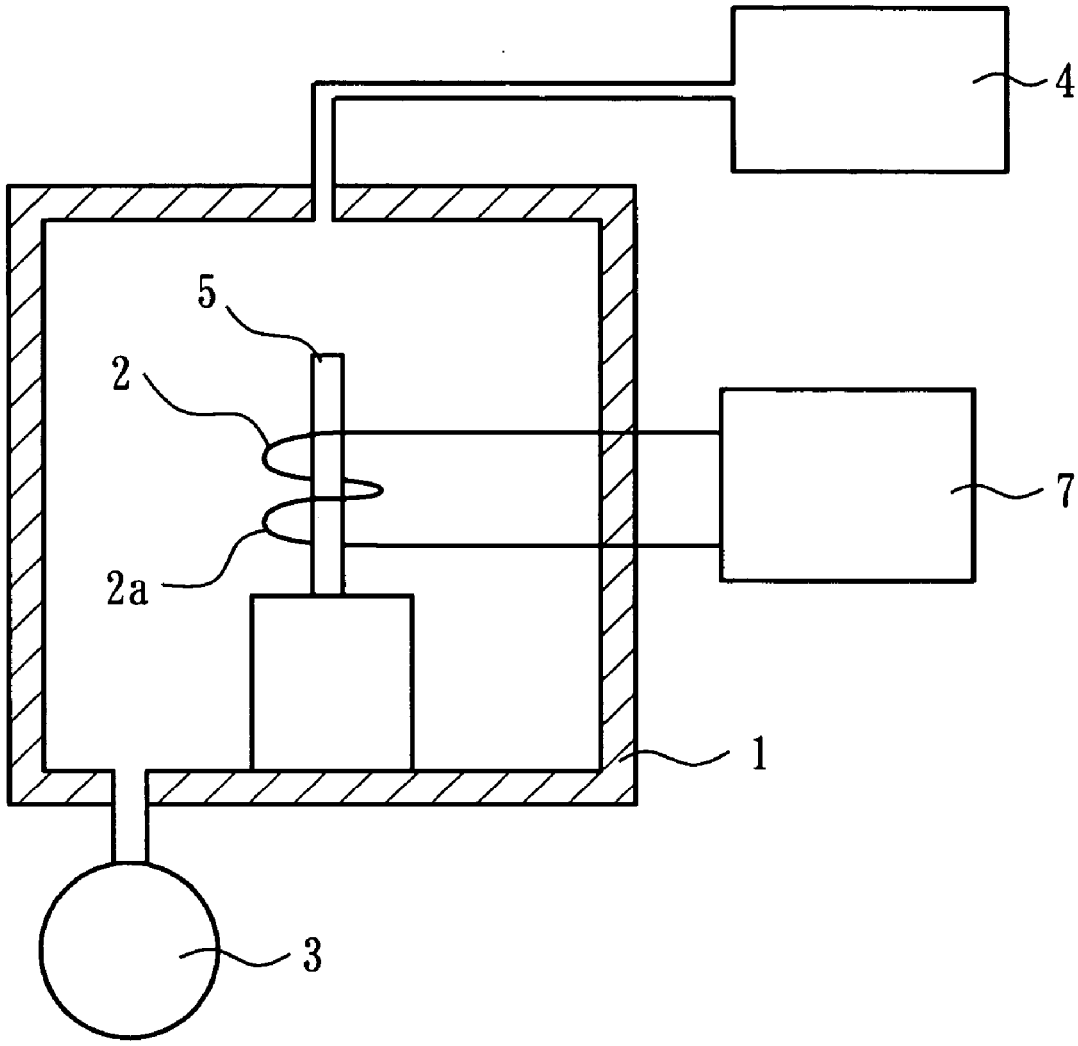
FIG. 4 illustrates the state of heating a treatment object with the gas carburizing apparatus in an embodiment of the present invention.

To be more precise, as shown in FIG. 4, the steel treatment object 5 is set to the heating device 2, the air present inside the vacuum container 1 is evacuated with the vacuum pump 3, a gas for carburizing atmosphere is introduced into the vacuum container 1 from the gas source 4 to raise the pressure of the carburizing atmosphere to the set pressure, the gas for carburizing atmosphere is supplied at a constant flow rate from the gas source 4 into the vacuum container 1, and the gas for carburizing atmosphere is released at a constant flow rate with the vacuum pump 3. As a result, the partial pressure of carburizing gas in the carburizing atmosphere inside the vacuum container 1 is set at not higher than the upper limit value that was predetermined as a limiting carburization condition. Then, the steel treatment object 5 is heated to the carburizing temperature with the heating device 2. The carburizing temperature is set at a value which is not higher than the aforesaid peritectic point temperature and not less than the eutectic point temperature. The carburizing temperature during heating of the sample 5' can be reproduced during heating of the treatment object 5 by controlling the heating device 2 in the same manner as during heating of the sample 5', and therefore, it is not necessary to weld the thermocouple 6 to the treatment object 5. Gas carburization is carried out by holding the treatment object 5 for the set carburizing time under the set partial pressure of carburizing gas and set carburizing temperature.

For example, when gas carburization of the steel treatment object 5 is carried out, the carburizing temperature is set at a temperature which is not higher than the peritectic point temperature at which δ iron and liquid phase are transformed into γ iron and not less than the eutectic point temperature at which liquid phase is transformed into γ iron and cementite. Furthermore, the target value of carbon concentration in the surface of the treatment object 5 is set at a value which is not higher than a value at which the surface of the treatment object 5 is not melted at the set carburizing temperature. Further, the partial pressure of carburizing gas in the carburizing atmosphere is set at a value at which the carbon concentration in the surface of the treatment object can reach the set target value as a result of gas carburization carried out during a preset period. The set value of the partial pressure of carburizing gas corresponding to the carburizing time can be predetermined by experiments. The set values of the carburizing time and partial pressure of carburizing gas are less than the aforesaid upper limit values corresponding to the set temperature. Therefore, the setting of the carburizing time and partial pressure of carburizing gas is facilitated by predetermining the aforesaid upper limit values.

Figure 5:
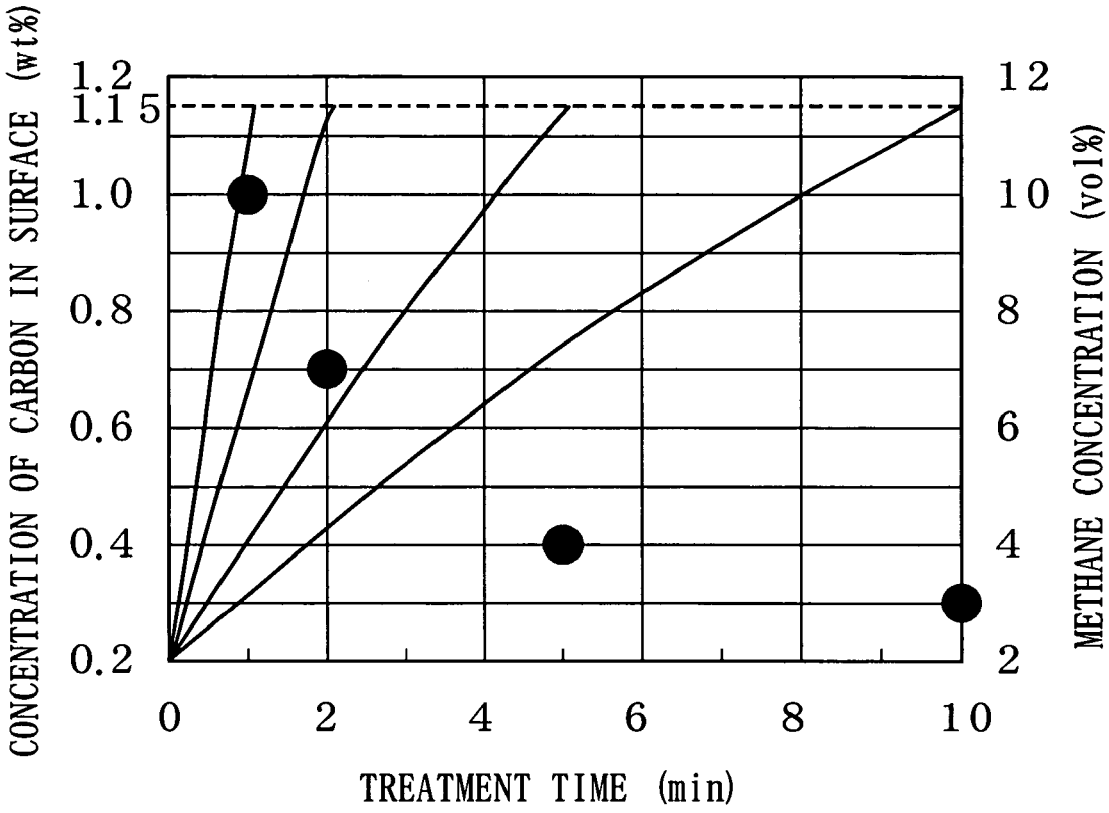
FIG. 5 illustrates the relationship between the carburizing treatment time till the surface of the treatment object starts melting at a carburizing temperature of 1573 K, partial pressure of carburizing gas, and concentration of carbon in the surface.
Figure 6:
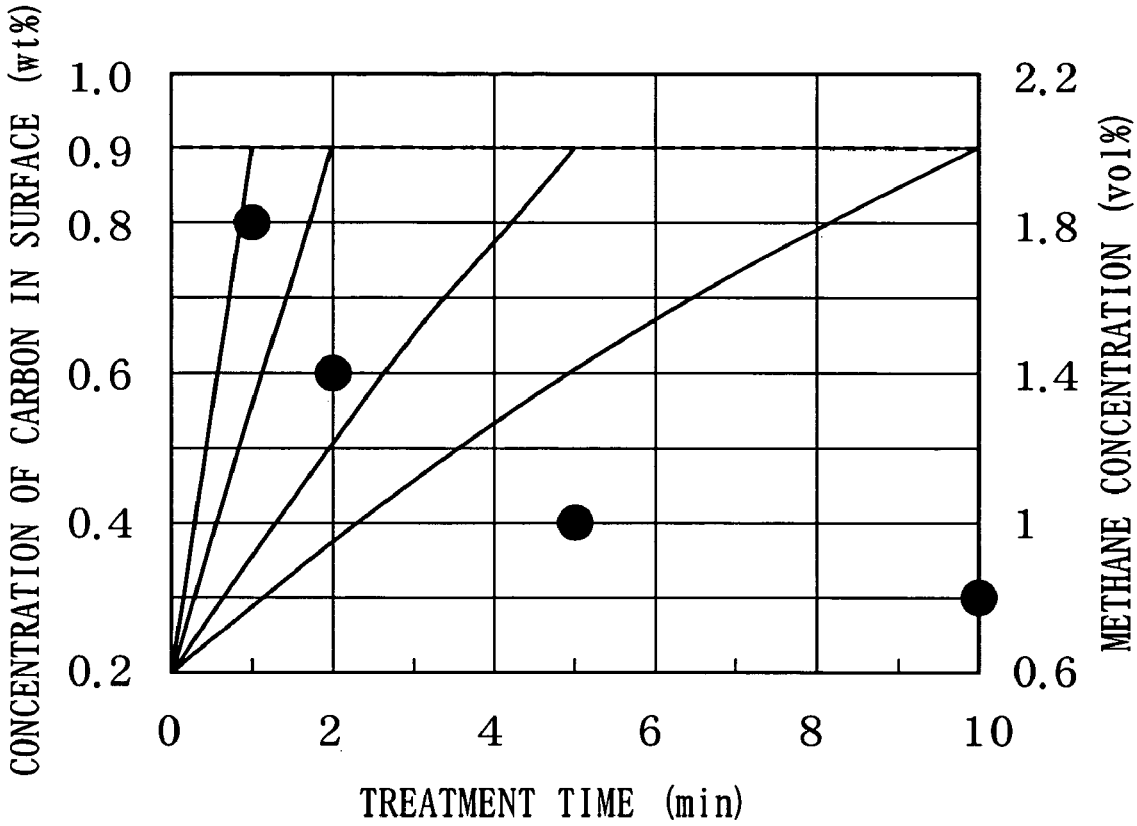
FIG. 6 illustrates the relationship between the carburizing treatment time till the surface of the treatment object starts melting at a carburizing temperature of 1623 K, partial pressure of carburizing gas, and concentration of carbon in the surface.

For example, because the surface of the treatment object 5 starts melting at a carbon concentration of about 1.15 wt. % at a carburizing temperature of 1573 K, the relationship between the carburizing treatment time required for the surface of the treatment object 5 to start melting at a carburizing temperature of 1573 K, the partial pressure of carburizing gas, and the concentration of carbon in the surface is expressed by FIG. 5 from the relationship shown in FIG. 3. FIG. 5 demonstrates that when the carburizing temperature is set at 1573 K and the target value of carbon concentration in the surface of treatment object 5 is set at a concentration of less than 1.15 wt. % at which no melting occurs, the concentration of methane in the carbon atmosphere should be set at less than 10 vol % if the carburizing time is 1 min, and the concentration of methane in the carbon atmosphere should be set at less than 3 vol % if the carburizing time is 10 min. Furthermore, for example, since the surface of the treatment object 5 starts melting at a carbon concentration of about 0.9 wt. % at a carburizing temperature of 1623 K, the relationship between the carburizing treatment time required for the surface of the treatment object 5 to start melting at the carburizing temperature of 1623 K, the partial pressure of carburizing gas, and the concentration of carbon in the surface is shown by FIG. 6 from the relationship shown in FIG. 3. FIG. 6 demonstrates that when the carburizing temperature is set at 1623 K and the target value of carbon concentration in the surface of steel treatment object 5 is set at a concentration of less than 0.9 wt. % at which no melting occurs, the concentration of methane in the carbon atmosphere should be set at less than 1.8 vol % if the carburizing time is 1 min, and the concentration of methane in the carbon atmosphere should be set at less than 0.8 vol % if the carburizing time is 10 min.

Gas carburizing is carried out by holding the treatment object 5 for a set carburizing time under the aforesaid set partial pressure of carburizing gas and set carburizing temperature. Once the set carburizing time has elapsed, the carburizing is stopped by stopping the supply of carburizing gas or terminating the heating with the heating device 2.

With the method of gas carburizing according to the present invention, the carburizing time can be greatly shortened because the carburizing temperature range is set between not higher than the peritectic point temperature and not less than the eutectic temperature. Moreover, setting the partial pressure of carburizing gas to not higher than the predetermined upper limit value makes it possible to carry out the carburization at a high temperature without melting the surface layer of the steel treatment object 5. For example, the diffusion coefficient of carbon atoms in γ iron is $3.59\times10^{-5}$ $mm^2$/sec at a temperature of 1000° C., but increases to ten or more times, that is, $43\times10^{-5}$ $mm^2$/sec at a temperature of 1300° C. Thus, the migration speed of carbon atoms at a temperature of 1300° C. is not less than tenfold that at a temperature of 1000° C. Therefore, the time required to obtain the desired carburization depth can be greatly reduced and the usual carburization depth can be obtained at a carburizing time of about 1 to 10 min. Moreover, because the concentration of carbon in the surface layer of the treatment object 5 does not exceed the set target value, a carbon diffusion treatment step becomes unnecessary. As a result, the carburizing treatment time can be greatly shortened and the productivity can be increased. Furthermore, the gas carburization treatment step can be carried out in series with other heat treatment steps. Setting the carburizing temperature at not less than 1200° C. is preferred from the standpoint of shortening the carburizing time, and this temperature can be set at not less than 1300°.

Furthermore, because gas carburization is carried out while causing the carburizing atmosphere comprising the carburizing gas at a constant partial pressure to flow inside the vacuum container 1, a constant partial pressure of carburizing gas can be maintained and the uniformity of the quality of treatment object 5 can be improved. Moreover, no soot generation was observed in the carburizing treatment implemented according to the present invention, and in this respect, too, the present invention is greatly superior to the conventional vacuum carburizing.

Figure 1:
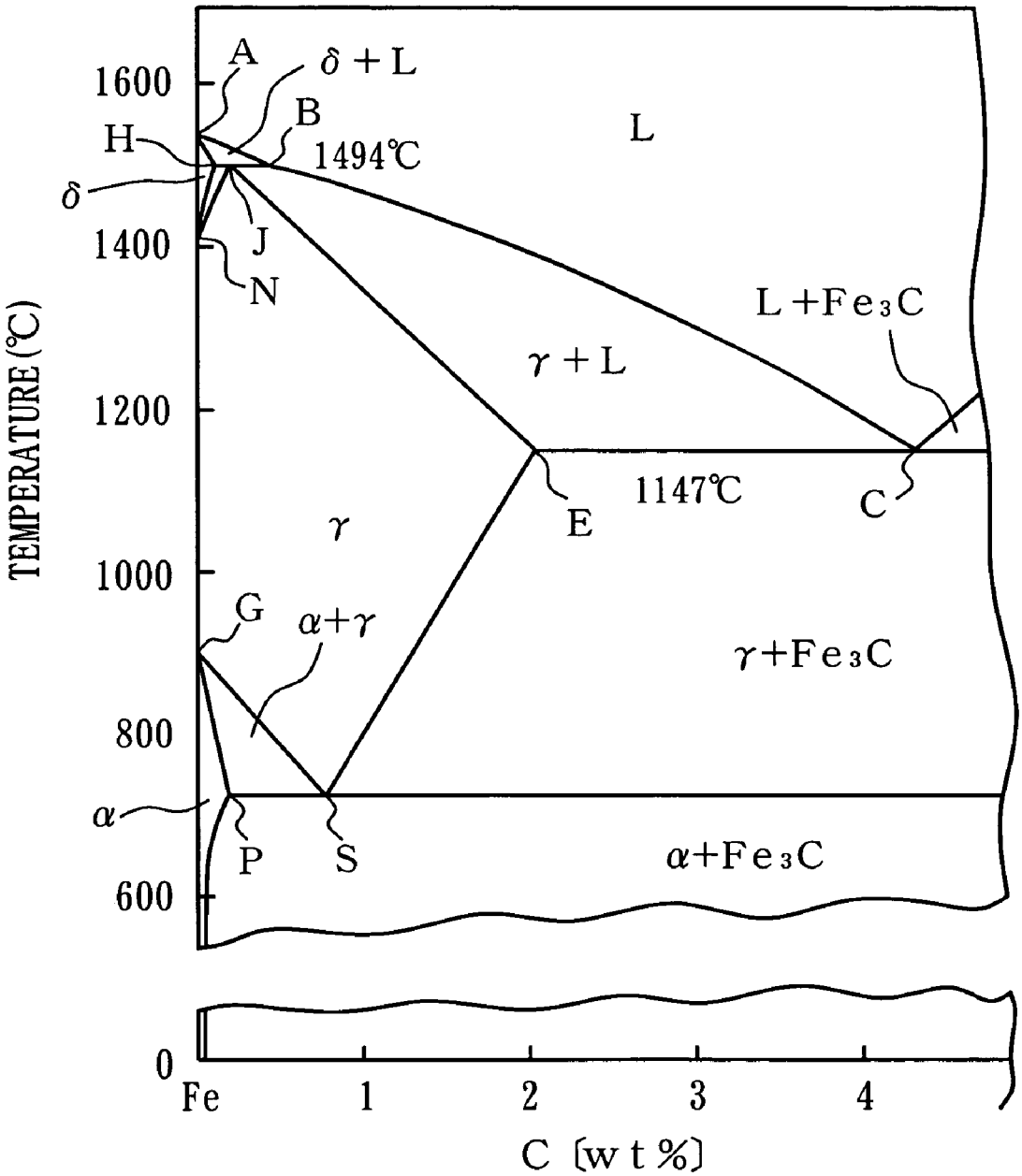
FIG. 1 is an iron-carbon equilibrium diagram.

Once the aforesaid gas carburizing has been completed, the treatment object 5 is cooled without carrying out the diffusion treatment. No specific limitation is placed on the cooling method, and natural cooling or a variety of forced cooling methods can be used. Furthermore, the treatment object 5 subjected to gas carburization is preferably quenched by reheating after cooling and then rapidly cooling. A secondary quenching may also be carried out by employing the primary cooling as a rapid cooling. The atmosphere for carrying out the quenching is preferably a neutral protective atmosphere, that is, the atmosphere in which the treatment object is neither carburized nor decarburized at this temperature, but the treatment can be carried out in another atmosphere of such as inert gas. The reheating temperature for quenching is set at not less than the temperature at which at least the surface layer of the treatment object 5 is austenitized above the GS line or ES line in the equilibrium diagram shown in FIG. 1.

EXAMPLE 1

With the method of gas carburizing of the above-described embodiment according to the present invention, the limiting carburizing conditions were predetermined and gas carburization was carried out under the carburizing conditions that are set so as not to contradict the limiting carburizing conditions. The treatment object 5 had a shape of right cylinder with a diameter of 10 mm and a length of 52 mm made of a nickel-chromium-molybdenum steel (Japanese Industrial Standard SNCM420). In the present example, the carburized treatment object 5 was naturally cooled inside the vacuum container 1, hardened, polished, and finish processed with a diamond paste with a particle size of 3 micrometers, followed by hardness measurements and structure observations. The vacuum container 1 was purged prior to the carburization. The carburizing gas was methane and the dilute gas was nitrogen. During carburization, the gas for carburizing atmosphere was caused to flow inside the vacuum container 1 at a constant flow rate of 0.5 L/min. Hardening was carried out by holding the treatment object 5 for 10 min inside a quartz tube furnace kept at a temperature of 860° C. in which the nitrogen gas atmosphere was flowed and then quenched into oil. It goes without saying that furnaces of other types, including the induction heating furnaces, can be used for the hardening.

Figure 7:
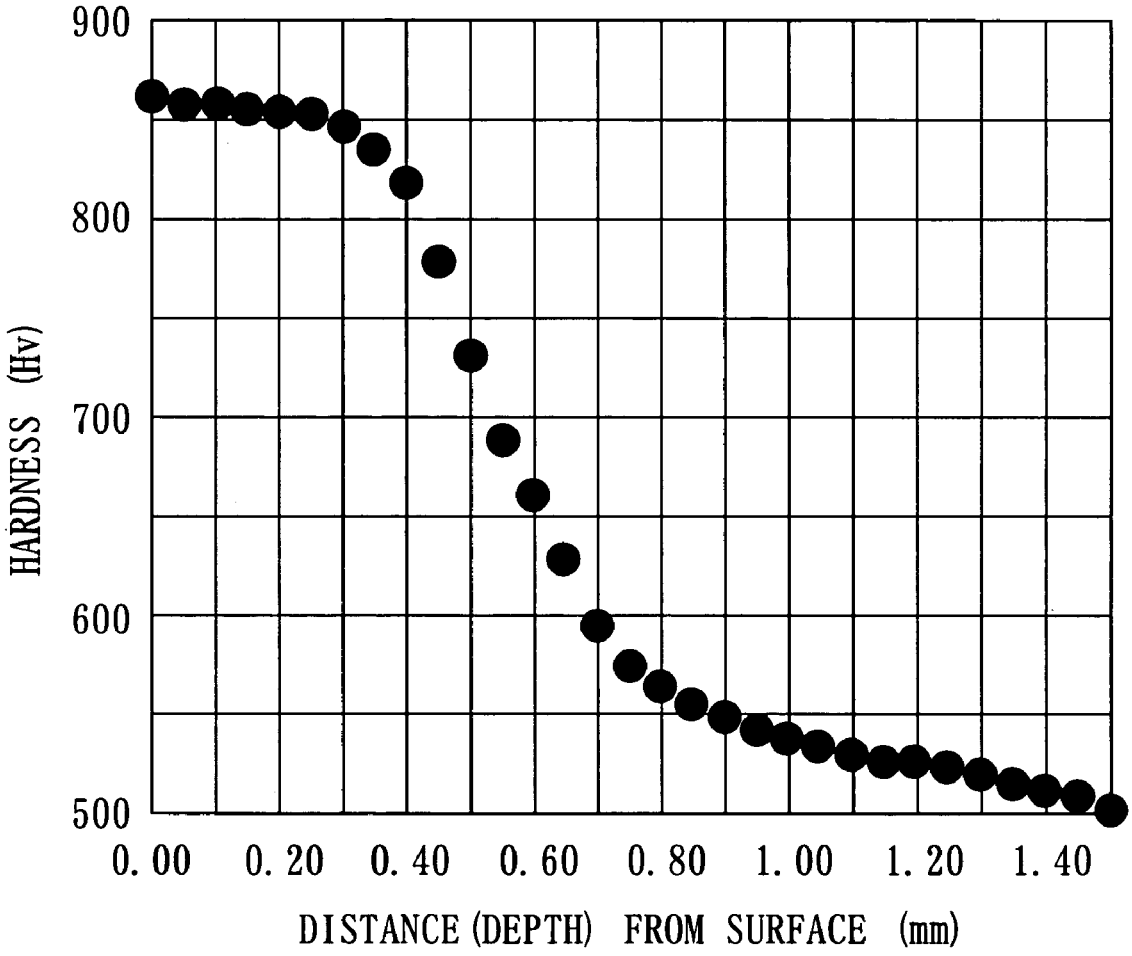
FIG. 7 shows the relationship between the hardness and the distance (depth) from the surface of the treatment object carburized with a carburizing time of 1 min at a carburizing temperature of 1250° C. in an example of the present invention.

FIG. 7 shows the relationship between the hardness (Hv) and the distance (depth) (mm) from the surface of the treatment object 5 that was gas carburized under the following carburizing conditions: carburizing temperature 1250° C., carburizing time 1 min, and concentration corresponding to partial pressure of methane, which is the carburizing gas, 40 vol %. In this case, the target value of carbon concentration in the surface of the treatment object 5 was set at 1.4 wt. %.

Figure 8:
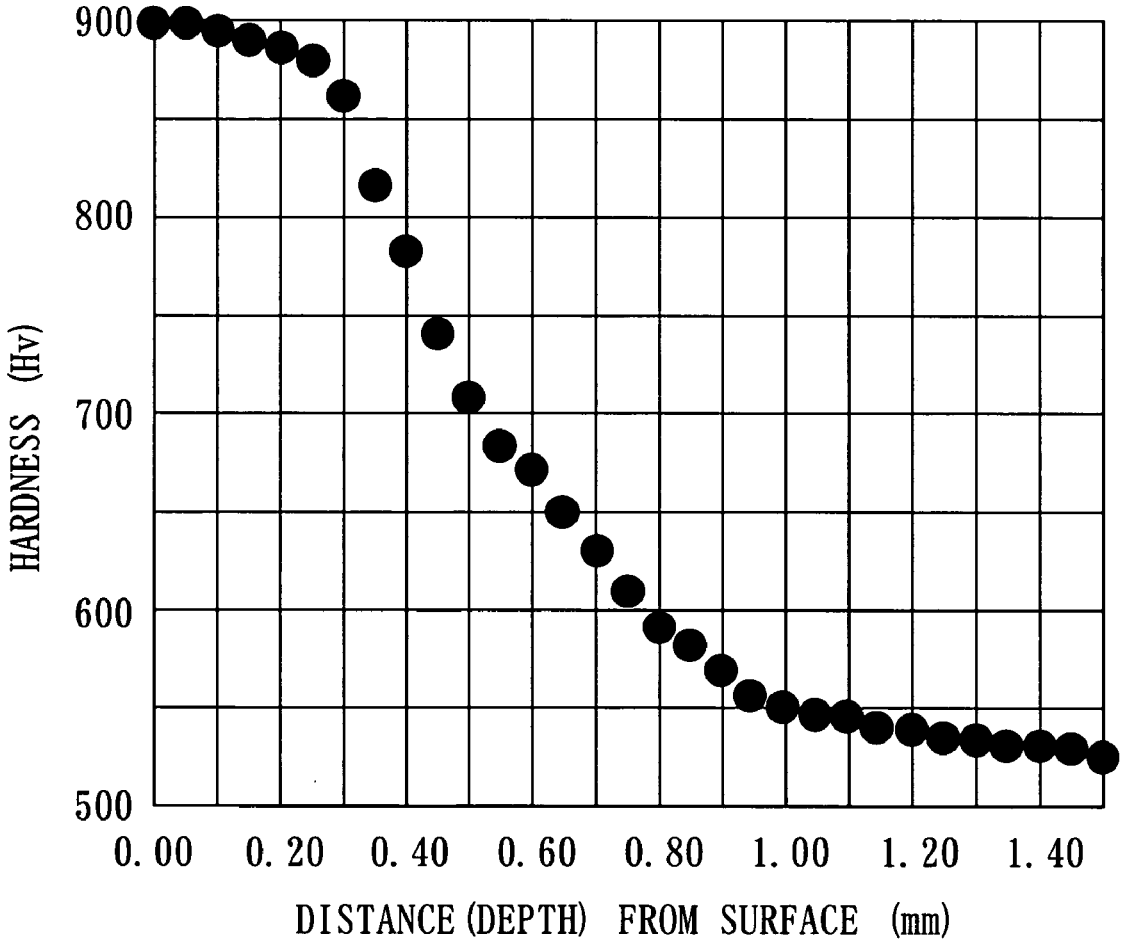
FIG. 8 shows the relationship between the hardness and the distance (depth) from the surface of the treatment object carburized with a carburizing time of 1 min at a carburizing temperature of 1300° C. in an example of the present invention.

FIG. 8 shows the relationship between the hardness (Hv) and the distance (depth) (mm) from the surface of the treatment object that was gas carburized under the following carburizing conditions: carburizing temperature 1300° C., carburizing time 1 min, and concentration of methane, which is the carburizing gas, 10 vol %. In this case, the target value of carbon concentration in the surface of the treatment object 5 was set at 1.15 wt. %.

Figure 9:
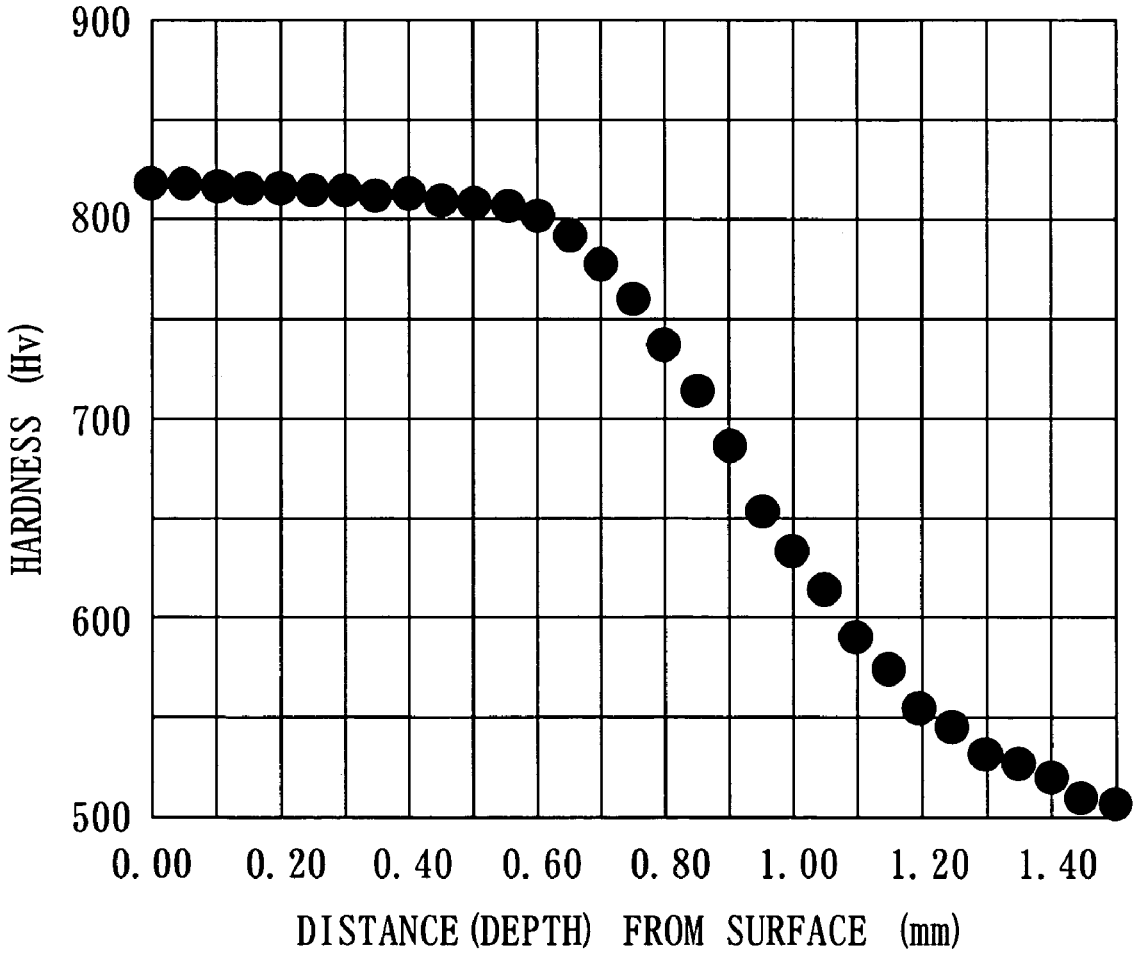
FIG. 9 shows the relationship between the hardness and the distance (depth) from the surface of the treatment object carburized with a carburizing time of 10 min at a carburizing temperature of 1250° C. in an example of the present invention.

FIG. 9 shows the relationship between the hardness (Hv) and the distance (depth) (mm) from the surface of the treatment object 5 that was gas carburized under the following carburizing conditions: carburizing temperature 1250° C., carburizing time 10 min, and concentration corresponding to partial pressure of methane, which is the carburizing gas, 10 vol %. In this case, the target value of carbon concentration in the surface of the treatment object 5 was set at 1.4 wt. %.

Figure 10:
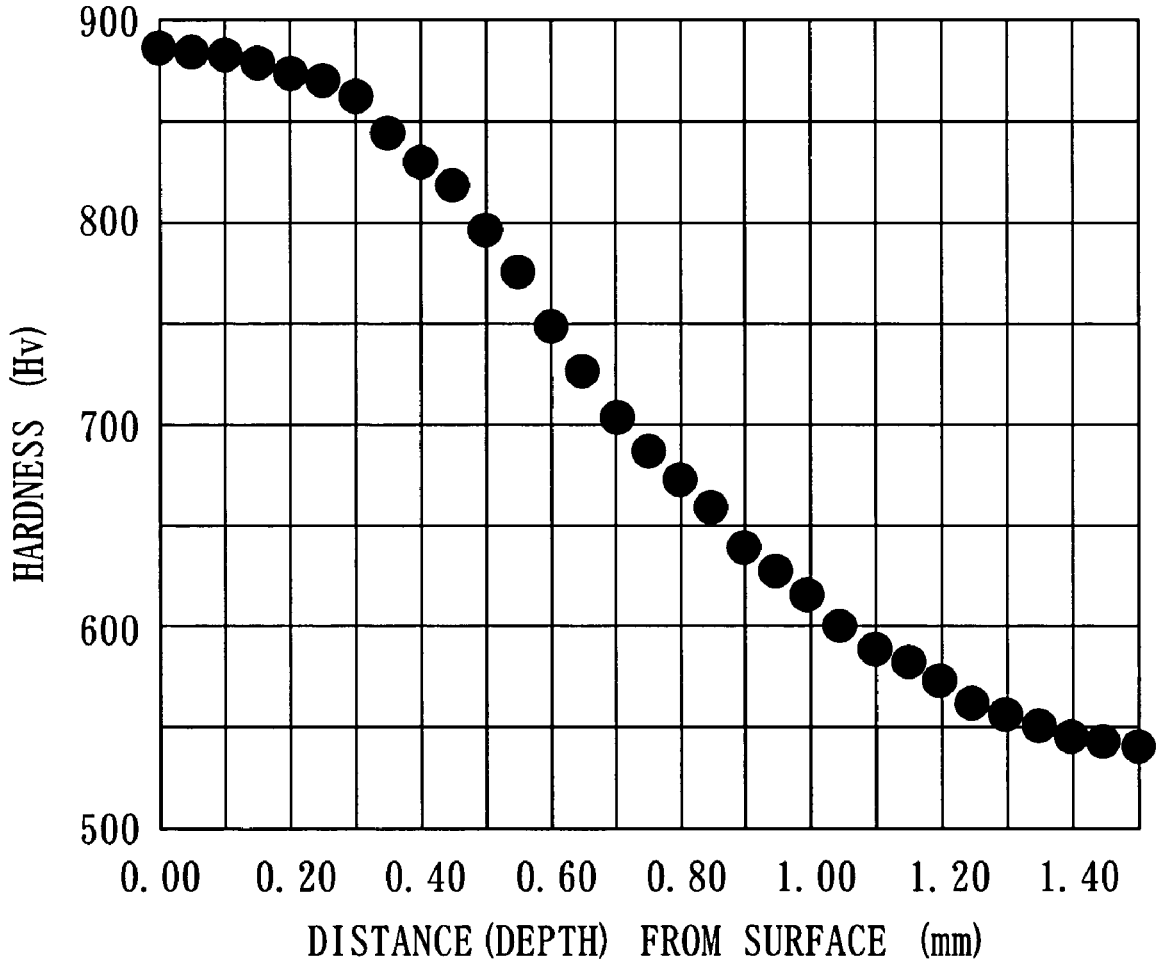
FIG. 10 shows the relationship between the hardness and the distance (depth) from the surface of the treatment object carburized with a carburizing time of 10 min at a carburizing temperature of 1300° C. in an example of the present invention.

FIG. 10 shows the relationship between the hardness (Hv) and the distance (depth) (mm) from the surface of the treatment object that was gas carburized under the following carburizing conditions: carburizing temperature 1300° C., carburizing time 10 min, and concentration of methane, which is the carburizing gas, 3 vol %. In this case, the target value of carbon concentration in the surface of the treatment object 5 was set at 1.15 wt. %.

FIGS. 7 through 10 confirm that the carburized layer with a sufficient effective carburization depth can be obtained within a carburizing time of 1 through 10 min. Further, the partial pressure of methane, which is a carburizing gas, is obtained by multiplying the total pressure of carburizing atmosphere by the methane concentration. In the example shown in FIGS. 7 through 10, the total pressure of carburizing atmosphere was about 80 kPa.

Figure 11:
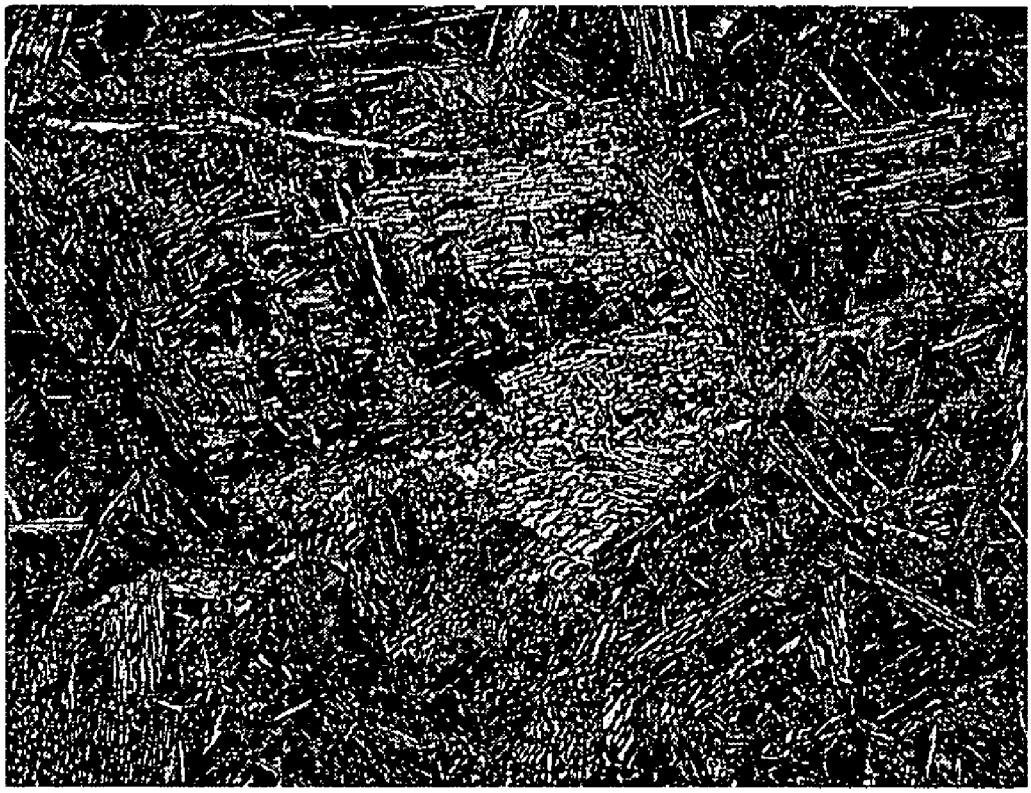
FIG. 11 is a microphotograph as a substitution for a drawing illustrating the metallurgical structure prior to quenching in the surface layer of the gas-carburized treatment object.
Figure 12:
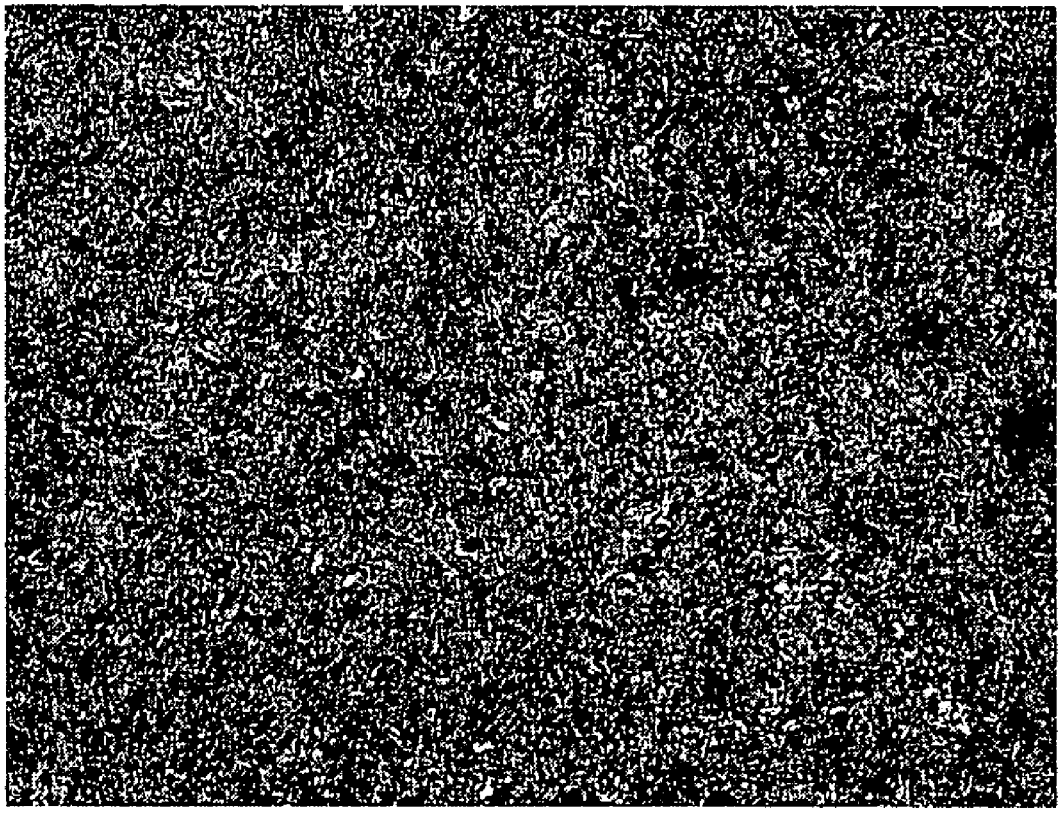
FIG. 12 is a microphotograph as a substitution for a drawing illustrating the metallurgical structure after quenching in the surface layer of the gas-carburized treatment object.

The metal structure prior to quenching of the surface layer of the treatment object 5 subjected to gas carburizing at a carburizing temperature of 1300° C. for a carburizing time of 1 min in accordance with the present invention is shown in FIG. 11. The metallurgical structure after quenching is shown in FIG. 12. A coarse structure that was present prior to quenching is not present after the quenching, which confirms that quenching makes the coarse structure fine.

EXAMPLE 2

Figure 13:
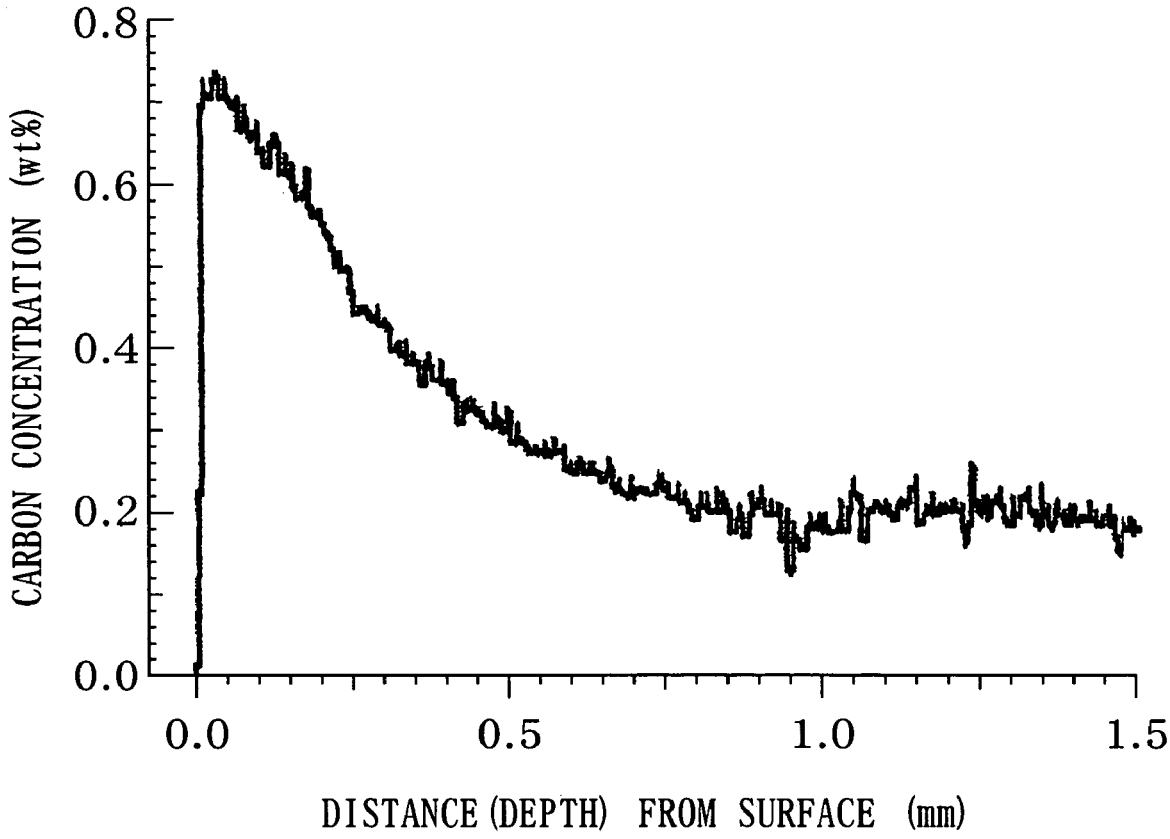
FIG. 13 illustrates the relationship between the concentration of carbon and the distance (depth) from the surface of the treatment object obtained in an example of the present invention.

Gas carburization was carried out under the carburizing conditions that were set by the gas carburization method of the above-described embodiment of the present invention. The treatment object 5 had a shape of right cylinder with a diameter of 10 mm and a length of 52 mm made of a nickel-chromium-molybdenum steel (Japanese Industrial Standard SNCM420) as used in the above-described embodiment. The carburized treatment object 5 was naturally cooled inside the vacuum container 1, without being subjected to diffusion treatment, then was hardened, polished, and finish processed with a diamond paste with a particle size of 3 micrometers. The vacuum container 1 was purged prior to the carburization. The carburizing gas was methane and the dilute gas was nitrogen. Hardening was carried out by holding the treatment object 5 for 10 min inside a quartz tube furnace kept at a temperature of 860° C. in which nitrogen gas atmosphere was flowed and then quenched into oil. It goes without saying that furnaces of other types, including the induction heating furnaces, can be used for the hardening. The carburizing temperature was 1300° C., the carburizing time was 1 min, the concentration corresponding to the partial pressure of methane, which is the carburizing gas, in the carburizing atmosphere was 10 vol %, the target value of carbon concentration in the surface of the treatment object 5 was 0.74 wt. %, the total pressure of carburizing atmosphere was 80 kPa, and the gas for carburizing atmosphere was flowed inside the vacuum container 1 during the carburization at a constant flow rate of 0.5 L/min. FIG. 13 shows the relationship between the concentration of carbon (wt. %) and the distance (depth) (mm) from the surface of the treatment object 5 obtained in the present example. In the present example, the depth to which the concentration of carbon was higher than 0.2 wt. % of the base metal, that is, the complete carburizing depth, was 0.9 mm, thereby confirming that the sufficient effective carburizing depth can be obtained without employing a diffusion treatment step. Furthermore, the results obtained were matched well with the results on the complete carburizing depth obtained from FIG. 8.

Figure 14:
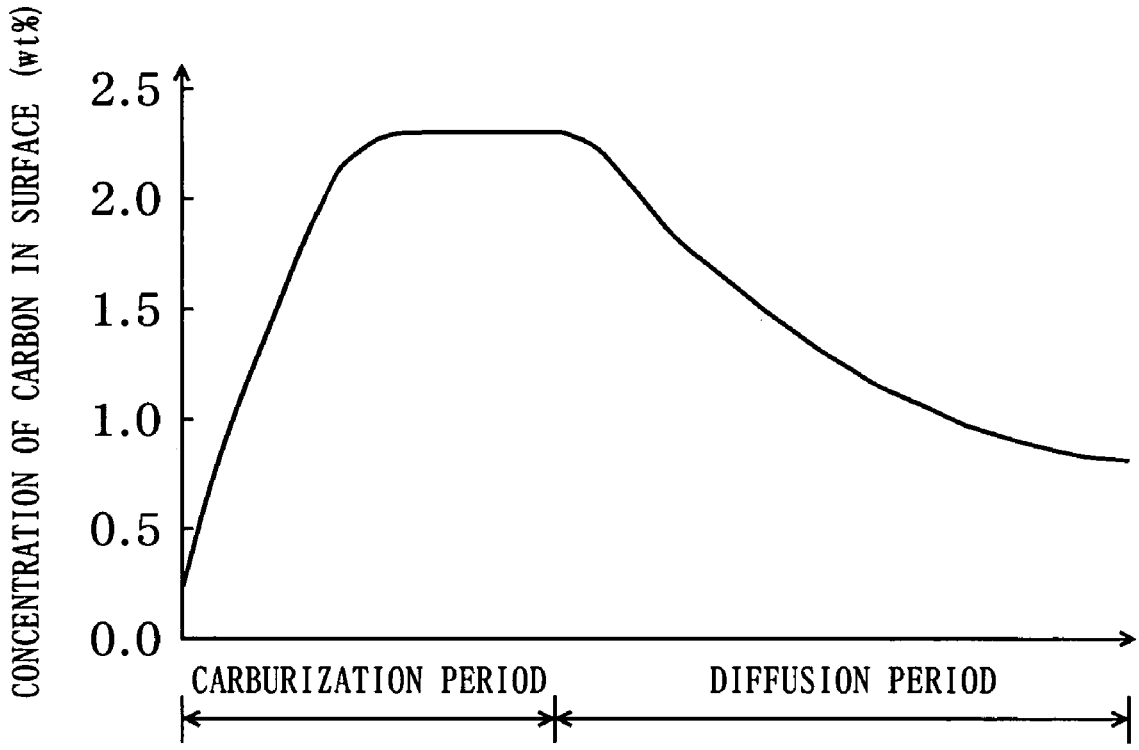
FIG. 14 illustrates an example of the relationship between the carburizing time, diffusion time, and concentration of carbon in the treatment object that was treated by the conventional carburizing method.

According to the above-described examples, the concentration of carbon in the surface of the treatment object 5 can be brought to the target value and a sufficient carburizing depth can be obtained without employing a diffusion treatment. By contrast, FIG. 14 shows an example of the relationship between the concentration of carbon in the surface and carburizing time in the treatment object obtained by the conventional carburizing method, in which because the concentration of carbon exceeds the target value when only the carburizing treatment is carried out, a subsequent diffusion treatment has to be carried out.

The present invention makes it possible to shorten significantly the carburizing time by raising the carburizing temperature. Moreover, because the concentration of carbon in the surface layer of the treatment object 5 does not exceed the set target value, the carbon diffusion treatment becomes unnecessary and productivity can be increased.

The present invention is not limited to the above-described embodiments and examples and can be modified variously within the scope of the present invention.

The invention claimed is:

1. A method of gas carburizing comprising the steps of:

experimentally predetermining limiting carburizing conditions at which a surface layer of a sample of a steel treatment object present in a carburizing atmosphere is austenitized without melting at a carburizing temperature which is not higher than a peritectic point temperature at which δ iron and liquid phase are transformed into γ iron and is greater than a eutectic point temperature at which liquid phase is transformed into γ iron and cementite; and gas carburizing the treatment object under carburizing conditions which are set so as not to contradict the limiting carburizing conditions, at a carburizing temperature which is not higher than the peritectic point temperature and is greater than the eutectic point temperature, wherein the limiting carburizing conditions comprise:

an upper limit value of a partial pressure of carburizing gas in the carburizing atmosphere at which the surface layer of the sample is austenitized without melting; and an upper limit value of carburizing temperature at which the surface layer of the sample is austenitized without melting and an upper limit value of carburizing time at which the surface layer of the sample is austenitized without melting;

a relationship between the upper limit value of the partial pressure of carburizing gas, the upper limit value of carburizing temperature, and the upper limit value of carburizing time is predetermined; and a partial pressure of carburizing gas, a carburizing temperature, and a carburizing time are set as a set of carburizing conditions of the treatment object so as not to contradict the limiting carburizing conditions which satisfy the predetermined relationship.

2. The method of gas carburizing according to claim 1, wherein said upper limit value of the partial pressure of carburizing gas, said upper limit of carburizing temperature, and said upper limit of carburizing time are determined by fixing two of said partial pressure of carburizing gas, said carburizing temperature, or said carburizing time.

3. The method of gas carburizing according to claim 2, wherein said upper limit of said partial pressure of carburizing gas is found by fixing the carburizing temperature and the carburizing time.

4. The method of gas carburizing according to claim 1, wherein said upper limit value of the partial pressure of carburizing gas, said upper limit of carburizing temperature, and said upper limit of carburizing time are utilized to determine a fastest possible carburization without melting the surface of said steel treatment object, said fastest possible carburization being a carburization to a set concentration of carbon at the surface of the steel treatment object and a carburization to a desired depth.

5. The method of gas carburizing according to claim 2, wherein said upper limit value of the partial pressure of carburizing gas, said upper limit of carburizing temperature, and said upper limit of carburizing time are utilized to determine a fastest possible carburization without melting the surface of said steel treatment object, said fastest possible carburization being a carburization to a set concentration of carbon at the surface of the steel treatment object and a carburization to a desired depth.

6. A method of gas carburizing comprising gas carburizing a steel treatment object, wherein limiting carburizing conditions at which a surface layer of a sample of a steel treatment object present in a carburizing atmosphere is austenitized without melting at a carburizing temperature which is not higher than a peritectic point temperature at which δ iron and liquid phase are transformed into γ iron and is greater than a eutectic point temperature at which liquid phase is transformed into γ iron and cementite are experimentally predetermined;

the limiting carburizing conditions comprise an upper limit value of a partial pressure of carburizing gas in the carburizing atmosphere at which the surface layer of the sample is austenitized without melting, an upper limit value of carburizing temperature at which the surface layer of the sample is austenitized without melting, and an upper limit value of carburizing time at which the surface layer of the sample is austenitized without melting;

the carburizing temperature is set at a temperature which is not higher than the peritectic point temperature and is greater than the eutectic point temperature;

a target value of carbon concentration in a surface of the treatment object is set at a value which is lower than any value at which the surface of the treatment object is melted at the set carburizing temperature;

the partial pressure of carburizing gas in the carburizing atmosphere is set at a value at which the carbon concentration in the surface of the treatment object can reach the set target value as a result of gas carburization carried out during a preset carburizing time without contradicting the limiting carburizing conditions; and said gas carburizing is carried out while causing the carburizing gas at a constant partial pressure to flow into a container containing said steel treatment object to thereby maintain a constant partial pressure of carburizing gas in said container.

7. The method of gas carburizing according to claim 6, wherein the treatment object is cooled without carrying out a diffusion treatment after the gas carburization has been carried out.

8. The method of gas carburizing according to claim 7, wherein the treatment object is reheated after the cooling.

9. The method of gas carburizing according to claim 8, wherein hardening of the reheated treatment object is carried out.

10. The method of gas carburizing according to any of claims 6 to 9, wherein the carburizing temperature is set at 1200° C. or higher.

* * * * *